US005385274A

United States Patent [19]

Twyman

[11] Patent Number: 5,385,274

[45] Date of Patent: Jan. 31, 1995

[54] MORTAR COMPOSITION AND EXTRUSION GUN

[76] Inventor: Guy L. Twyman, 1228 Gaylord St., Denver, Colo. 80206

[21] Appl. No.: 920,760

[22] Filed: Jul. 28, 1992

[51] Int. Cl.[6] ..... B65D 88/54

[52] U.S. Cl. ..... 222/327; 222/386; 222/566; 210/251; 106/713

[58] Field of Search ..... 222/327, 386, 566, 575, 222/611.2, 569; 425/87; 239/124; 210/251, 498; 106/713, 716, 721, 738

[56] References Cited

U.S. PATENT DOCUMENTS

| | | | |
|---|---|---|---|
| 2,821,332 | 1/1958 | Sherbondy | 222/569 |
| 3,162,886 | 12/1964 | Wise | 222/611.2 X |
| 3,487,982 | 1/1970 | Rowe | 222/569 |
| 4,174,868 | 11/1979 | De Nardo | 222/327 X |
| 5,042,695 | 8/1991 | Battegazzore | 222/386 X |
| 5,054,658 | 10/1991 | Aronie | 222/611.2 X |
| 5,226,575 | 7/1993 | Faust | 222/611.2 X |
| 5,234,497 | 8/1993 | Crocker | 106/713 X |
| 5,254,228 | 10/1993 | Westhof et al. | 106/713 X |

FOREIGN PATENT DOCUMENTS

| | | | |
|---|---|---|---|
| 2224782 | 5/1990 | United Kingdom | 222/611.2 |

OTHER PUBLICATIONS

Chapter 4 Mortar, pp. 2, 59 & 62; Copyright 1977 by The Goodheart-Willcox Co., Inc.

Audel Masons And Builders Library vol. II by Louis M. Dezetell revised by Tom Philbin; cover pg. copyright pg., pp. 29 and 31; 1984.

Masonry Construction: The Trowel Worker's Bible; by J. M. Nickey; cover page; copyright page, pp. 35 and 36; 1982.

The Complete Concrete, Masonry, And Brick Handbook by Jeannette T. Adams; cover page, copyright page, pp. 427 and 428; 1983.

Construction Principles, Materials & Methods by Harold B. Olin, A.I.A., John S. Chmidt, A.I.A. and Walter H. Lewis, A.I.A.; cover page, copyright page; pp. 205-23-205-28; 1980.

Masonry simplified vol. 1 Tools, Materials, Practice Bricklaying, Concrete Block and Cement Masonry, J. Ralph Dalzell and Gilbert Townsend; cover page, copyright page, pp. 46, 49,55 & 57; 1948.

*Primary Examiner*—Gregory L. Huson

[57] ABSTRACT

A mortar extrusion gun includes a refillable and cleanable mortar supply tube possessing a first end terminating in a forwardly and radially inwardly extending flange surrounding a mortar ejection aperture and a second opposite open end. A conical spout includes a tip provided with a mortar outlet aperture and a base possessing a mortar inlet aperture surrounded by a radially outwardly extending flange. Preferably, a set of spouts possessing various different dimensions are provided for selective use under different working conditions. In an assembled condition, the spout is inserted through the supply tube and ejection aperture such that the inwardly and outwardly extending flanges abut in sealing relation, supporting the spout at the first end of the supply tube. After the supply tube is filled with mortar, a packing disk is inserted into the open end of the supply tube, and the supply tube and spout assembly is inserted into a slightly modified conventional caulking gun. Various disclosed embodiments of the packing disk possess different profile configurations and may include pressure relief vent apertures or cracks to diminish separation of water from the mortar within the supply tube and resultant clogging of the gun. Various mortar compositions suitable for pressure application and dependent upon mortar joint width are disclosed. The mortar extrusion gun is intended for use in precisely, completely, and rapidly applying mortar to joints during construction and repair of masonry structures.

19 Claims, 6 Drawing Sheets

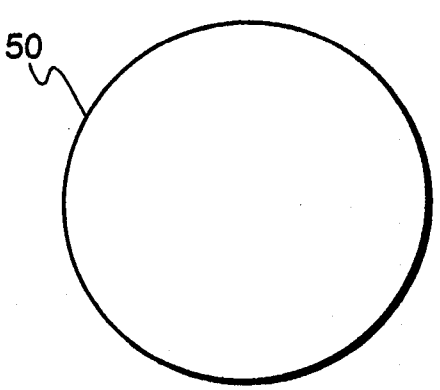
Fig. 9
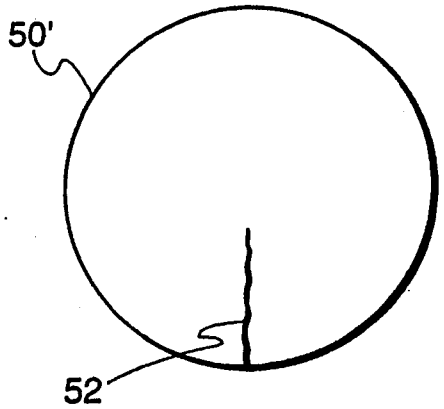
Fig. 10
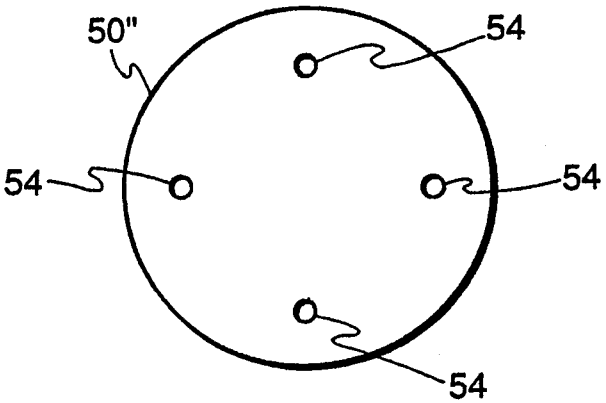
Fig. 11
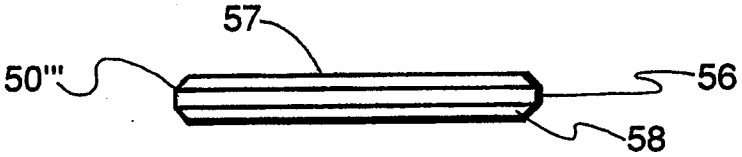
Fig. 12
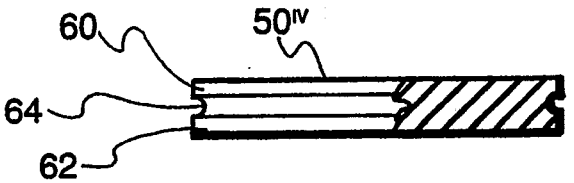
Fig. 13
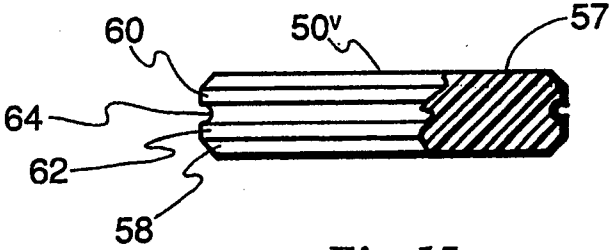
Fig. 14
Fig. 15

MORTAR COMPOSITION AND EXTRUSION GUN

BACKGROUND OF THE INVENTION

The present invention relates to masonry construction, and more particularly pertains to an improved mortar extrusion gun especially adapted for use in applying mortar in joints formed between adjacent masonry construction units such as bricks, tiles, stones, pavers, and the like. In the initial construction and repair of masonry structures such as walls, fireplaces, chimneys, patios, etc., it is frequently necessary to apply mortar into the joint region formed between two adjacent masonry construction units. In the past, this operation, known as "tuck pointing", has been typically performed by (1) mixing a relatively stiff mortar mix from cement, sand, lime, and water; (2) holding a quantity of the mortar mix on a trowel adjacent the joint area; and (3) manually "stuffing" the joint with mortar from the trowel utilizing a so-called "tuck pointer" tool. This prior art manual method is disadvantageous for many reasons. First, the process is slow and tedious. Second, the relatively stiff (dry) mortar dries rapidly and is thus difficult to work with, particularly on large jobs. Third, the manual stuffing method tends to result in uneven joints possessing irregular depth and thickness and tends to smear the face of the bricks with mortar. Fourth, the manual stuffing tuck pointing technique requires a great deal of practice to perform at commercially acceptable levels of quality and speed. Fifth, the dry mortar required for manual stuffing is difficult to introduce into narrow and/or deep mortar joints and has reduced adhesion to old, dry bricks compared with a looser, wetter mortar mixture. Accordingly, it is essentially impossible to apply a thin veneer of new mortar over old mortar joints when repairing a masonry structure, which is necessary to produce an aesthetically acceptable result.

Several alternative solutions have been proposed in the prior art in attempts to solve these problems. One prior art method, seldom used by professionals, involves the filling of an open ended squeezable bag possessing an application nozzle with mortar and manually squeezing the bag to extrude mortar from the bag through the nozzle and into the mortar joint. This so-called "grout glove" method has been found disadvantageous because of the difficulty in filling the bag, the difficulty in expressing mortar from the bag into the desired joint area at a uniform rate, and the tendency of the application nozzle to clog results in commercially unacceptable levels of quality and speed. Further, the grout glove is very messy and difficult to use, partially because of its open ended construction. The grout glove method also suffers from very inaccurate pressure and flow control, a requirement for stiff, dry mortar, and messy and incomplete injection of mortar into masonry joints.

Still another prior art attempt to solve the uniform application rate, quality, and speed problems involves the use of a variable speed electric pump which pumps mortar from a hopper through a hose to an application nozzle. Controls located at the nozzle regulate pump speed to control mortar application rates. A motor actuated paddle maintains the mortar homogeneously mixed within the hopper. Nonetheless, this pump method has several serious disadvantages. First, a large amount of mortar must be mixed to operate the system, even for very small jobs. Second, the supply hose introduces a large amount of friction, resulting in frequent clogging. Third, the system requires a relatively large mortar extrusion aperture to avoid constant clogging, and is thus not suited for use with narrow mortar joints. Fourth, the pump system lacks adequate pressure and volume flow rate control. Fifth, the system requires two experienced workmen to operate properly. Sixth, the system is prohibitively expensive for most applications.

Reloadable caulking guns known for the application of latex and silicone caulking compounds are available from Albion Engineering Company of Philadelphia, Pa. These so-called bulk load guns employ a threaded loading sleeve and threaded adaptor ring for a cone tip, both of which must be screwed on and off while manually holding the long heavy gun in a vertical orientation. Threaded connections are incompatible with mortar applications due to the abrasive nature of the cementitious particles, which foul and rapidly wear mating threads. The bulk load guns are difficult to clean and possess exposed internal working parts which would be subject to damage if exposed to contact with abrasive cementitious particles. Due to the short set up time of mortar in tuck pointing, a workman would need to purchase about eight relatively expensive bulk load guns to perform at acceptable production rates.

SUMMARY OF THE INVENTION

In order to overcome the above-described problems and disadvantages associated with the prior art tuck pointing methods, and to achieve other objects of the invention described hereinafter, the present invention provides a mortar extrusion gun which includes a refillable and cleanable mortar supply tube possessing a first end terminating in a forwardly and radially inwardly extending flange surrounding a mortar ejection aperture and a second opposite open end. A conical spout includes a tip provided with a mortar outlet aperture and a base possessing a mortar inlet aperture surrounded by a radially outwardly extending flange. Preferably, a set of spouts possessing various different aperture sizes are provided for selective use under different working conditions. In an assembled condition, the spout is inserted through the supply tube and ejection aperture such that the inwardly and outwardly extending flanges abut in sealing relation, supporting the spout at the first end of the supply tube. After the supply tube is filled with mortar, a packing disk is inserted into the open end of the supply tube, and the supply tube and spout assembly is inserted into a slightly modified conventional caulking gun. Various disclosed embodiments of the packing disk possess different profile configurations and may include pressure relief vent apertures or cracks to diminish separation of water from the mortar within the supply tube and resultant clogging of the gun. Various mortar compositions suitable for pressure application and dependent upon mortar joint width are disclosed. The mortar extrusion gun is intended for use in precisely, completely, and rapidly applying mortar to joints during construction and repair of masonry structures.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 9 is a top plan view of a first alternative packing disk for use with the mortar extrusion gun.

FIG. 10 is a top plan view of a second alternative packing disk, possessing a pressure relief crack, for use with the mortar extrusion gun.

FIG. 11 is a top plan view of a third alternative packing disk, possessing a plurality of pressure relief apertures, for use with the mortar extrusion gun.

FIG. 12 Is a side elevational view, partially in cross-section, of a leather packing disk possessing a first alternative cylindrical profile.

FIG. 13 is a side elevational view of a packing disk possessing a second alternative bevelled cylindrical profile.

FIG. 14 is a side elevational view, partially in cross-section, of a rubber packing disk possessing a third alternative grooved cylindrical profile.

FIG. 15 is a side elevational view, partially in cross-section, of a plastic packing disk possessing a fourth alternative grooved and bevelled cylindrical profile.

DETAILED DESCRIPTION OF THE PREFERRED EMBODIMENT(S)

Figure 1:
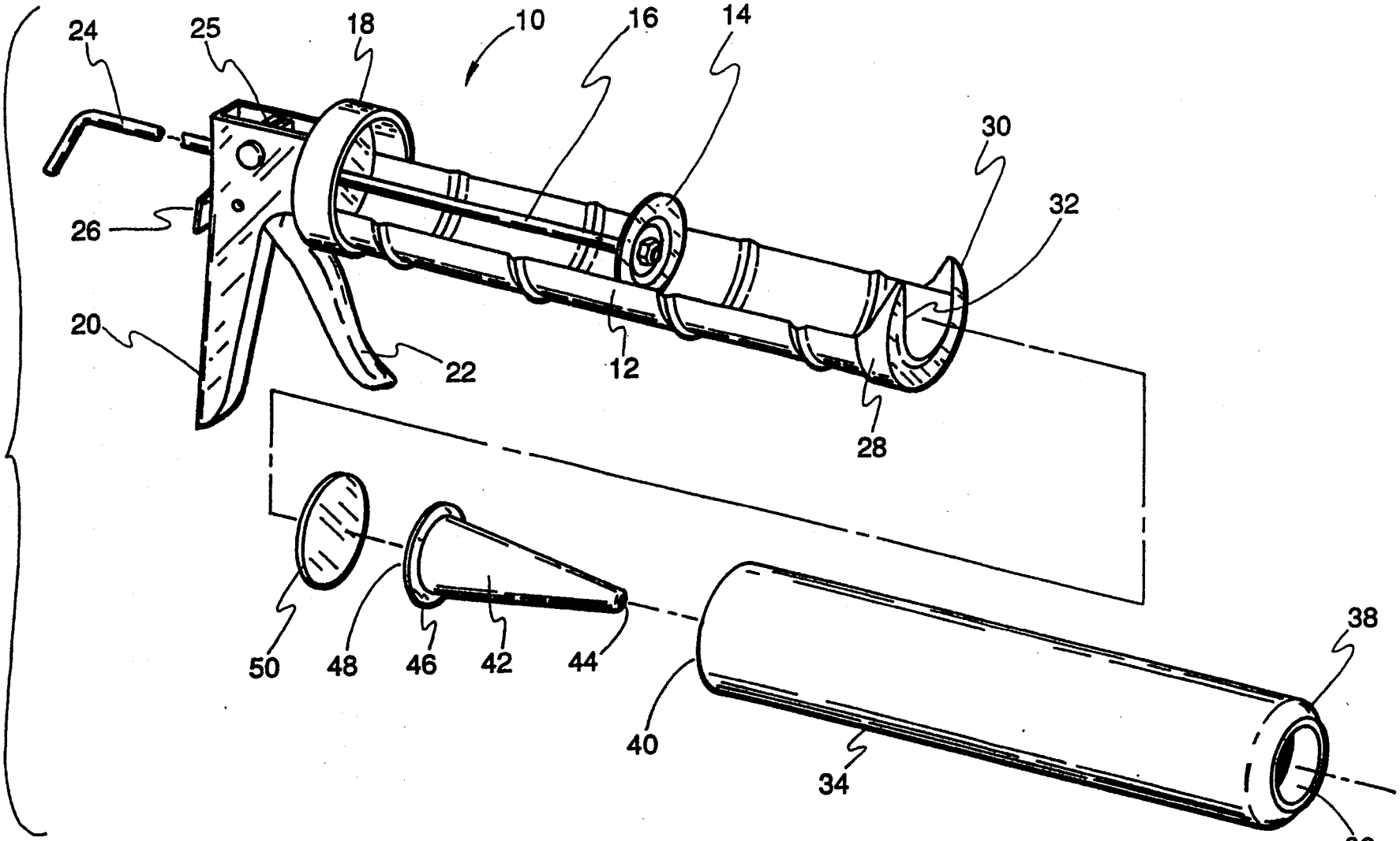
FIG. 1 is an exploded perspective view of the mortar extrusion gun according to the present invention.
Figure 2:
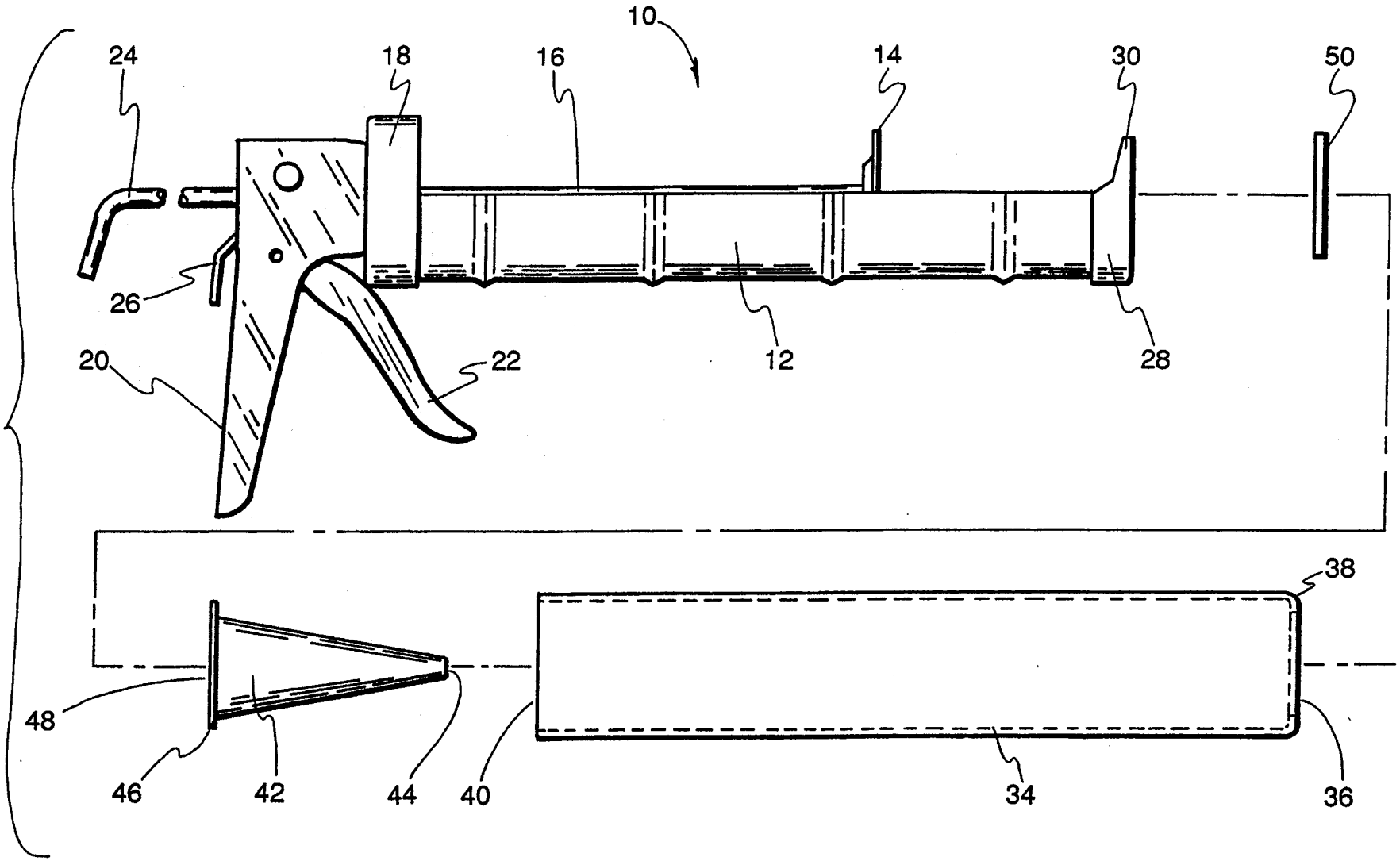
FIG. 2 is an exploded side elevational view illustrating the mortar extrusion gun.
Figure 3:
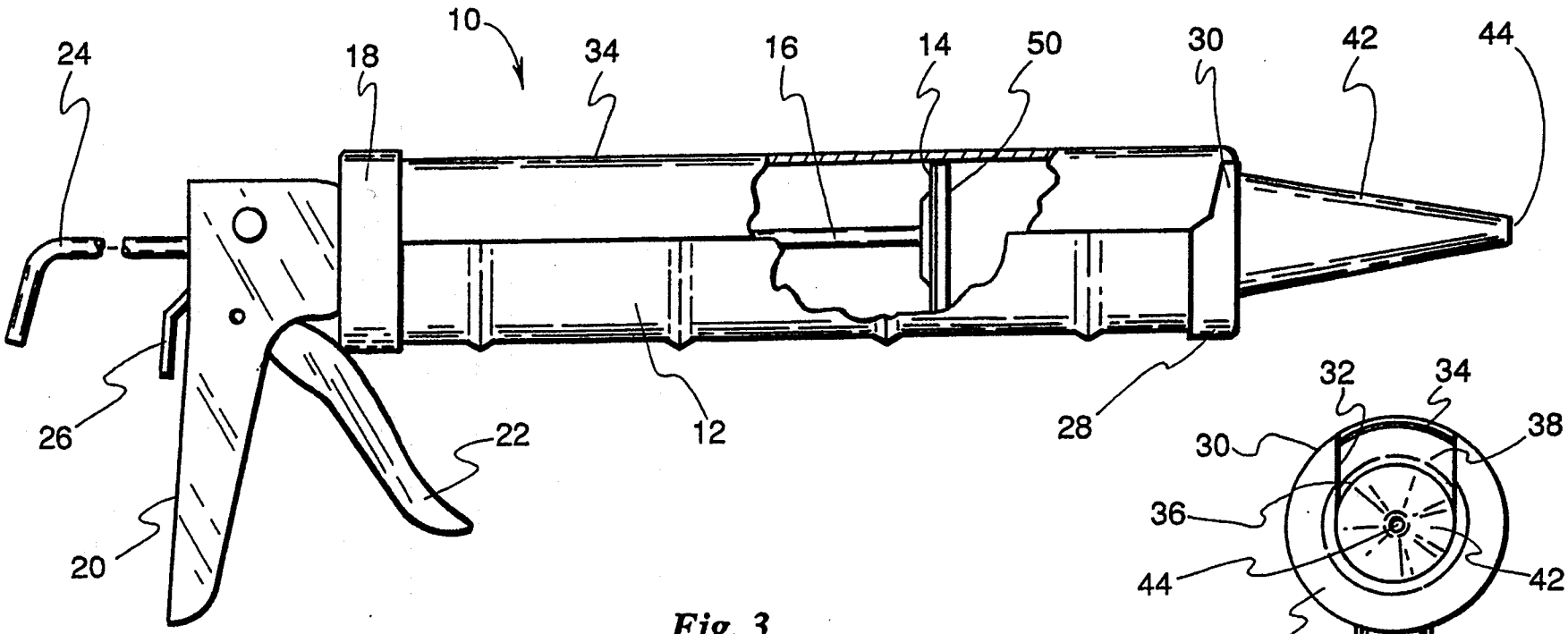
FIG. 3 is an assembled side elevational view, partially cut-away and in cross-section, illustrating the mortar extrusion gun.

Referring now to the drawings, wherein like reference numerals designate corresponding structure throughout the views, and referring in particular to FIGS. 1, 2, and 3, an improved mortar extrusion gun 10 according to a first preferred embodiment of the invention includes a semi-cylindrical tube supporting cradle 12 receiving a cylindrical piston 14 mounted for axial reciprocal movement on a piston rod 16. The piston rod 16 extends centrally through a cylindrical tube base support cup 18 and handle 20, terminating in an L-shaped piston retraction rod 24. Manual squeezing of pivotal trigger 22 toward handle 20 effects controlled forward movement of piston 14 via rod drive plate 25, toward substantially cylindrical tube spout support cup 28, in a well known manner. Axial retraction of piston 14 towards tube base support cup 18 may be effected by manual rearward movement of piston retraction rod 24 simultaneously with manual depression of release lever 26. The above-described components 12, 14, 16, 18, 20, 22, 24, 26, and 28 form a conventional caulking gun available from a variety of sources. One suitable caulking gun is Model #105 from Newborn Company, and bears the marking "U.S. Pat. No. 4,081,112". This caulking gun is available from a variety of construction equipment distributors, including Smalley & Co. located at 861 South Jason, Denver, Col. This preferred conventional caulking gun is of the type without ratchet teeth on the piston rod 16 or retraction rod 24, but instead of the type possessing a smooth piston drive rod 16 grabbed by drive plate 25, such that piston 14 will immediately stop in its current axial position upon release of trigger 22. Conventional ratchet type caulking guns effect discrete incremental axial movement of the piston 14, and thus do not provide accurate and precisely controlled delivery volume, pressure, rate, and flow stoppability.

Figure 4:
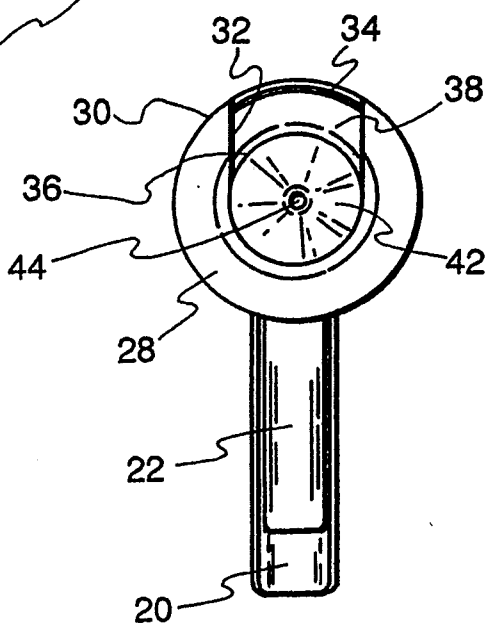
FIG. 4 is a front end view illustrating the mortar extrusion gun.
Figure 8:
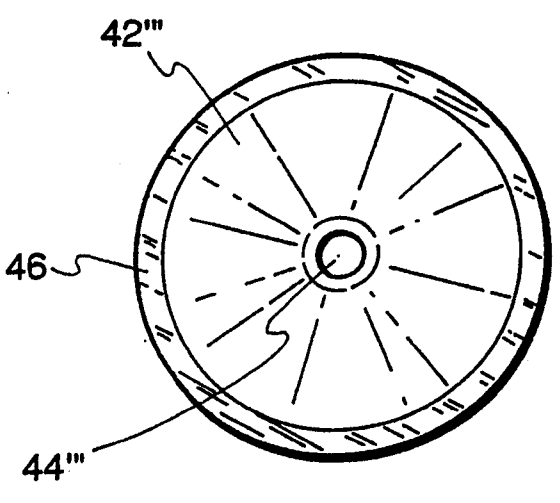
FIG. 8 is a tip end view of a spout similar to the extrusion spout of FIG. 5, but having a smaller diameter outlet aperture.
Figure 7:
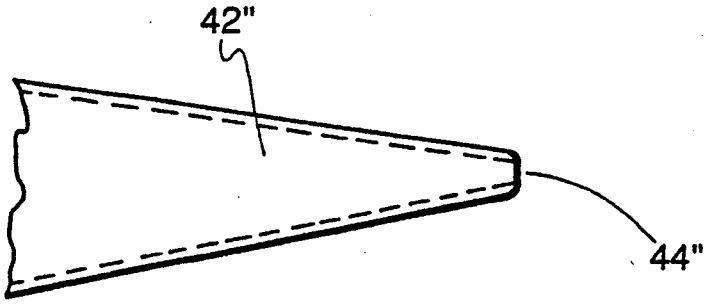
FIG. 7 is a partial side elevational view illustrating a spout similar to the extrusion spout of FIG. 5, but having a smaller diameter outlet aperture.
Figure 5:
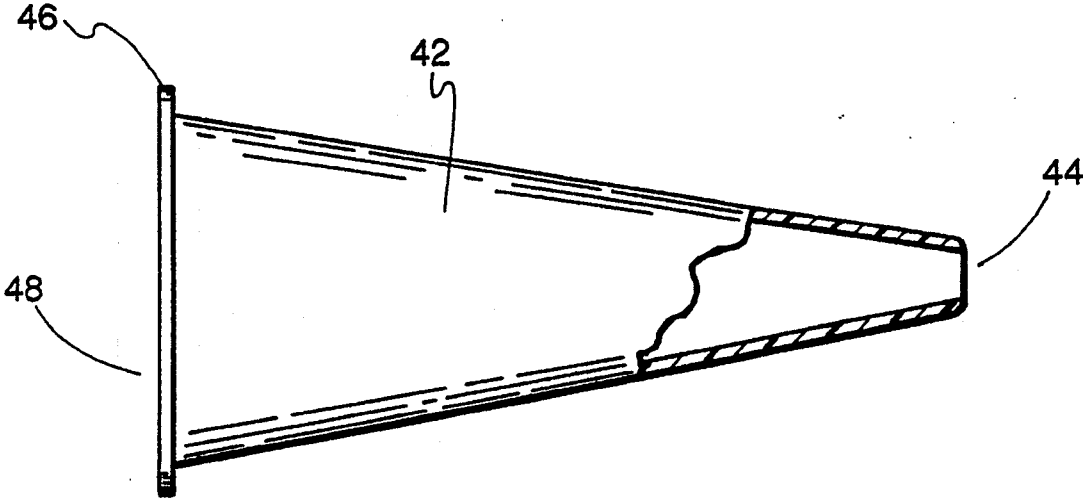
FIG. 5 is a side elevational view, partially cut-away and in cross-section, illustrating an extrusion spout for use with the mortar extrusion gun.

As depicted in FIGS. 1 and 4, this conventional caulking gun is modified in the construction of the mortar extrusion gun of the present invention by cutting an enlarged radially extending slot 32 from the top edge 30 of the tube spout support cup 28 dimensioned for the reception of conical extrusion spout 42. This modification essentially involves enlarging the existing conventional slot adapted for reception of the smaller spouts of conventional caulk tubes.

The mortar extrusion gun of the present invention includes a mortar supply tube 34 which may be formed from steel seamless tubing possessing an O.D. of 2.5 in. and an I.D. of 2.37 in. and having a length of 18 in. The forward end of the mortar supply tube 34 is swedged to form a radially inwardly and axially forwardly tapering retaining flange 38 surrounding a mortar ejection aperture 36. An opposite rearward open end 40 of the tube 34 allows filling of the tube 34 with mortar prior to use, preferably with the aid of a conventional funnel of the type employed in home fruit and vegetable canning to fill MASON (TM) jars. Suitable plastic materials may be utilized in the construction of the tube 34 utilizing conventional molding, casting, or extrusion processes, without departing from the scope of the present invention.

A conical extrusion spout 42 includes a forward spout outlet aperture 44 and an opposite spout inlet aperture 48 surrounded by a radially outwardly extending mounting flange 46. Prior to filling the mortar tube 34 with mortar, the spout 42 is inserted within the tube 34 and through the mortar ejection aperture 36, until the mounting flange 46 on the spout 42 abuts the retaining flange 38 of the tube 34. The tube 34 is then held with the outlet aperture 44 of the spout directed downwardly and filled with mortar. The weight of the mortar forces the flange 46 against the flange 38, forming a fluid seal. This abutting flange coupling avoids the use of threaded fasteners which are difficult to clean and prone to rapid wear and obstruction upon exposure to abrasive cementitious particles. The forwardly and inwardly tapering flange 38, in conjunction with conical spout 42, effects a gradual reduction of the transverse cross-sectional area of the mortar within tube 34, promoting clog-free extrusion of the mortar upon application of pressure.

Figure 6:
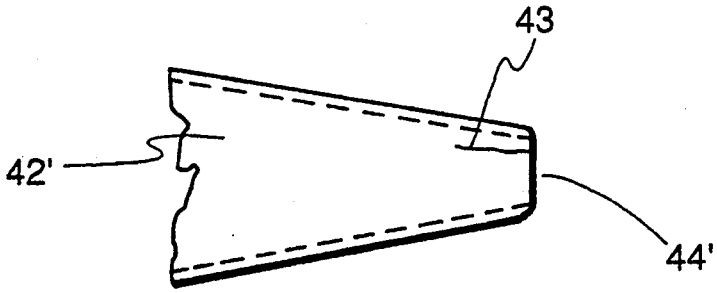
FIG. 6 is a partial side elevational view illustrating a spout similar to the extrusion spout of FIG. 5, but having a larger diameter outlet aperture.

As shown in FIG. 6, the spout 42' may be provided with a generally longitudinally extending crack 43 dimensioned to allow passage of air, but not cementitious particles, in order to provide a degree of pressure relief. Such pressure relief is considered desirable in connection with the pressure application of mortar, as discussed in more detail below.

As shown in FIGS. 5 through 8, the spout 42 is preferably formed from a plastic material and provided with the mortar extrusion gun as a set including a plurality of spouts each possessing a different diameter outlet aperture 44, 44', 44'', and 44''' in the range of $\frac{1}{8}$ in to $\frac{3}{8}$ in. Spouts of a generally suitable type are available from Albion Engineering Company located at 2080A Wheatsheaf Lane, Philadelphia, Pa. under the designation Plastic Cone #235-3, possessing a length of 4.5 in. and a base diameter of 1.625 in. These plastic spouts can be easily transversely severed to selectively vary the diameter of the outlet aperture 44. Preferably, the set of spouts consists of four spouts having outlet aperture diameters of 5/32, $\frac{1}{4}$, 5/16, and $\frac{3}{8}$ in., each having a length between 4 and 4.5 in.

After filling of the supply tube 34 with mortar, a packing disk 50 is manually inserted through open end 40. As shown in FIGS. 9 through 23, the packing disk may be formed in a variety of alternative configurations within the scope of the present invention. As shown, respectively, in FIGS. 12, 14, and 15, the packing disk may be formed from leather, rubber, or plastic materials. If leather is employed, the packing disk must be stored in water when not in use to prevent shrinkage.

Applicant hypothesizes that the use of a packing disk which effects an air tight seal with the interior wall of the tube 34 may, in certain applications using certain mortar compositions, be undesirable. The exertion of pressure on the mortar, via the packing disk, tends to initially expel the water from the mortar through spout outlet 44, thus drying the mortar remaining within the tube 34, resulting subsequent clogging. The provision of some degree of pressure relief past or through the packing disk is believed to minimize this problem. As a first mechanism of providing such pressure relief, the packing disk may be formed with a diameter sufficiently less than the I.D. of the tube 34 to allow air, but not cementitious particles, to pass between the sidewall of the packing disk and the inner wall of the tube 34. When employing leather packing disks, expansion and contraction of the leather due to absorption of water and subsequent drying renders the disks dimensionally unstable. One solution to this problem involves storing the leather packing disks in water so as to maintain them in a maximum dimension condition. Also, because the leather disk does not form a tight seal, the supply tube 34 must be maintained in a generally vertical orientation when filled to prevent the packing disk 50 and mortar from spilling out.

Alternatively, as depicted in FIG. 10, one or more small radial cracks, such as crack 52, may be formed in packing disk 50', with the crack 52 having a width sufficient to allow passage of air, but not cementitious particles. FIG. 11 illustrates a third alternative construction for providing such pressure relief, in which one or more vent apertures 54 are formed through packing disk 50''. The diameter of the vent apertures 54, shown greatly oversize in FIG. 11 for purposes of illustration, is very small, so as to allow passage of air, but not cementitious particles, through the disk 50''.

As shown in FIGS. 12 through 15, the profile configuration of the packing disk may take several alternative shapes within the scope of the present invention. For example, as shown in FIG. 12, the packing disk 50 may be entirely cylindrical. Alternatively, as depicted in FIG. 13, the packing disk 50''' may possess a cylindrical portion 56 merging with top and bottom beveled portions 57 and 58 adapted to facilitate insertion and removal of the disk 50''' from the open end 40 of the supply tube 34. In another embodiment, illustrated in FIG. 14, the packing disk $50^{IV}$ includes two cylindrical portions 60 and 62 separated by an equatorial circumferentially extending groove 64, preferably possessing a semicircular transverse cross-sectional shape. Finally, as shown in FIG. 15, the packing disk embodiment $50^{IV}$ shown in FIG. 14 may be provided with a bevelled end portions 57 and 58, to facilitate insertion and removal of the packing disk $50^{V}$ from the open end 40 of the supply tube 34. Packing disks $50^{IV}$ and $50^{V}$ provide a better fluid seal suited for use with wetter mortar mixtures.

Figure 18:
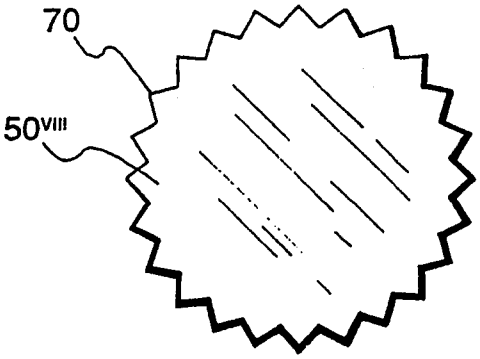
FIG. 18 is a top plan view of a seventh alternative packing disk possessing a coarse tooth serration configured periphery to allow pressure relief.
Figure 17:
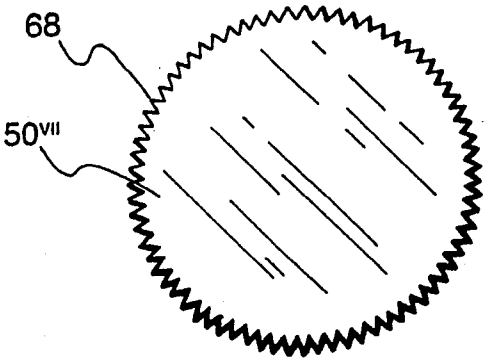
FIG. 17 is a top plan view of a sixth alternative packing disk possessing a fine tooth serration configured periphery to allow pressure relief.
Figure 16:
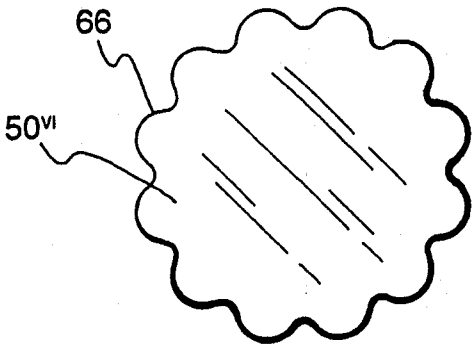
FIG. 16 is a top plan view of a fifth alternative packing disk possessing a generally sinusoidal wave form configured periphery to allow pressure relief.
Figure 19:
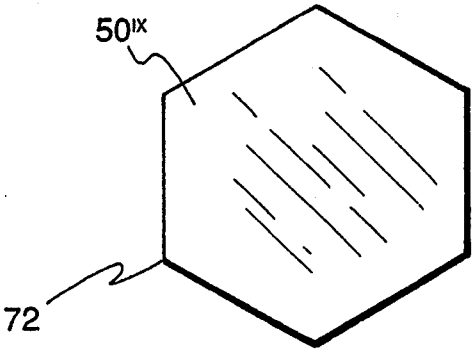
FIG. 19 is a top plan view of a eighth alternative packing disk possessing a hexagonal periphery configuration to allow pressure relief.

FIGS. 16 through 22 illustrate additional alternative packing disk constructions, each possessing a peripheral pressure relief configuration such that the outer peripheral edge of the packing disk does not seal tightly and completely against the interior sidewall of the mortary supply tube 34. In FIG. 16, the packing disk $50^{VI}$ possesses a generally sinusoidal wave form configuration such that only the convex crest portions of the wave will sealingly engage the inner sidewall of the tube 34. FIGS. 17 and 18 illustrate packing disk embodiments $50^{VII}$ and $50^{VIII}$ possessing fine 68 and coarse 70 serrated peripheral edge portions, respectively, to allow pressure relief around the peripheral edges of the disks. FIG. 19 illustrates a packing disk $50^{IX}$, possessing an extremely coarse serrated periphery 72, forming in effect a polygonal body portion. While a hexagonal shape is illustrated, it should be understood that more or fewer than six sides may be provided.

Figure 21:
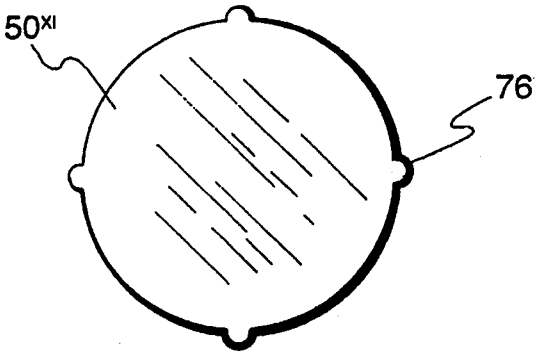
FIG. 21 is a top plan view of a tenth alternative packing disk possessing four circumferentially spaced radially projecting hemispherical peripheral protrusions to allow pressure relief.
Figure 20:
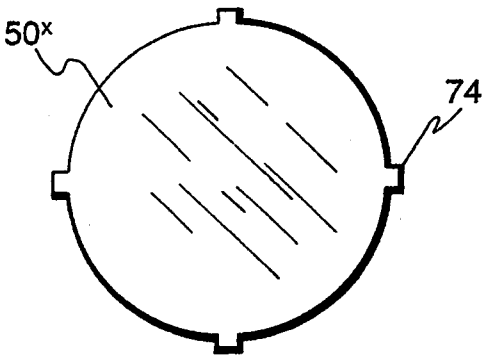
FIG. 20 is a top plan view of a ninth alternative packing disk possessing four circumferentially spaced radially projecting rectangular peripheral tabs to allow pressure relief.
Figure 22:
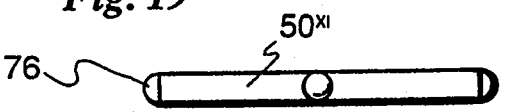
FIG. 22 is a side elevational view of the packing disk of FIG. 21.

FIGS. 20, 21, and 22 illustrate further packing disk embodiments $50^{X}$ and $50^{XI}$, in which circumferentially spaced, radially extending projections prevent a tight seal of the disk periphery with the inner sidewall of the tube 34. In FIG. 20 the projections take the form of four evenly circumferentially spaced rectangular tabs 74. FIGS. 21 and 22 depict similar hemispherical protrusions 76.

Figure 23:
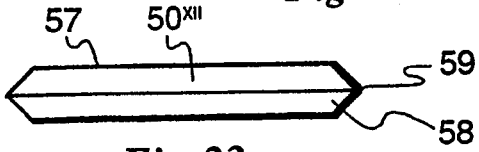
FIG. 23 is side elevational view of an eleventh alternative packing disk possessing oppositely tapering top and bottom bevel portions defining an equatorial circumferential sealing ridge.

FIG. 23 illustrates a further alternative packing disk$^{50XII}$, in which oppositely tapering top 57 and bottom 58 bevel portions intersect at an equatorial circumferentially sealing ridge 59 dimensioned for engagement with the inner sidewall of the tube 34.

It is contemplated that each of the different alternative packing disk profile configurations of FIGS. 12 through 23 may be formed of rubber, plastic, or leather, and may each also employ each of the various alternative pressure relief constructions described above.

In the method of using the mortar extrusion gun of the present invention, the composition of the mortar mix is critical, and varies, as does the aperture size of the spout employed, with the width of the mortar joint in the particular masonry structure. Conventional mortar mix compositions consist of portland cement, lime, sand, and water. In conjunction with the method of using the mortar extrusion gun of the present invention, experiments have shown that the use of lime (calcium carbonate) in the mortar mix is disadvantageous. Applicant is not certain of the scientific reason for this phenomena, but hypothesizes that mortar mix compositions which include lime exhibit undesirable characteristics in pressure application methods. Applicant further hypothesizes that anhydrous lime utilized in conventional mortar mixes has a tendency, even after the addition of water, to return to the anhydrous state upon the application of pressure. Specifically, upon exertion of pressure on the mortar in the supply tube 34 via the packing disk 50, a mortar composition including lime tends to initially expel water from the spout outlet aperture 44, drying the remaining mortar in the tube 34, and resulting in clogging of the gun.

Through experiments, Applicant has found that the use of a material sold under the trademark HILLBEST, with the designation #25 Concrete Pumping Agent, manufactured by Hill Brothers Chemical Company of Orange, Calif. 92667, in place of lime in the mortar mix overcomes, at least to a substantial degree, the tendency of the mortar to clog within the extrusion gun of the present invention. HILLBEST is a trade secret formulation of Hill Brothers Chemical Company, and Applicant is unaware of the composition of this material, used principally in spray plaster applications. Preferred mortar mix compositions, on a volumetric basis, along with mortar joint width and spout outlet aperture dimension parameters, in inches, are set forth in the following chart:

| Mortar Hardness Range | Mortar Joint Width | Tip Outlet Dia. | Parts Portland Cement | Parts HILL-BEST | Parts Sand | Parts Water |
|---|---|---|---|---|---|---|
| Normal | $\frac{1}{8}$ to 9/32 | $\frac{1}{8}$ to $\frac{1}{4}$ | 2.0 | 1.0 | 3.0 | 2.6 to 2.9 |
| Harder | $\frac{1}{8}$ to 9/32 | $\frac{1}{8}$ to $\frac{1}{4}$ | 2.0 | .85 | 3.33 | 2.6 to 2.9 |
| Normal | 9/32 to $\frac{5}{8}$ | $\frac{1}{4}$ to $\frac{3}{8}$ | 2.0 | 1.0 | 4.0 | 2.5 to 2.8 |
| Harder | 9/32 to $\frac{5}{8}$ | $\frac{1}{4}$ to $\frac{3}{8}$ | 2.0 | .85 | 4.4 | 2.5 to 2.8 |

A #4 screened sand is preferably employed in conjunction with mortar joint widths in the smaller $\frac{1}{8}$ to 9/32 in. range, while masonry sand is suitable for use with joint widths in the 9/32 to $\frac{5}{8}$ in. range.

As will be understood upon careful consideration of the parameters set forth in the above-chart, a harder or stiffer mixture is obtained by reducing the HILLBEST component by 15% and increasing the sand component by 10%.

Suitable dry mortar mix compositions may be sold in dry form premixed in plastic bags, requiring only the addition of a specified volume of water by the user. Further, the dry premix bags may be adapted, upon addition of water, to produce a predetermined quantity of mortar sufficient to fill a single invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A mortar extrusion gun, comprising:

a supply tube for holding a quantity of mortar to be dispensed, said supply tube including a mortar ejection aperture;

a spout including an outlet aperture for dispensing mortar;

means for, only upon at least partial filling of said supply tube with mortar, retaining and supporting said spout in fluid sealed relation with said supply tube upon insertion of said spout into said supply tube and at least partially through said mortar ejection aperture;

a packing disk dimensioned for insertion into an open end of said tube opposite said spout; and means for axially translating said packing disk within said supply tube to dispense mortar from said outlet aperture of said spout.

2. The mortar extrusion gun of claim 1, wherein said packing disk comprises leather.

3. The mortar extrusion gun of claim 1, wherein said packing disk comprises rubber.

4. The mortar extrusion gun of claim 1, wherein said packing disk comprises plastic.

5. The mortar extrusion gun of claim 1, further comprising mortar in said supply tube, said mortar consisting essentially of 2 parts cement, 3 to 4.4 parts sand, 0.85 to 1 part HILLBEST, and 2.5 to 2.9 parts water, on a volumetric basis.

6. The mortar extrusion gun of claim 1, wherein said packing disk has a diameter sufficiently less than the I.D. of said supply tube to allow air, but not cementitious particles, to pass between the sidewall of the packing disk and the inner wall of said supply tube.

7. In combination with a mortar extrusion gun including a spout and means for extruding mortar from said spout, the improvement comprising:

mortar consisting essentially of 2 parts cement, 3 to 4.4 parts sand, 0.85 to 1 part HILLBEST, and 2.5 to 2.9 parts water, on a volumetric basis.

8. The combination of claim 7 wherein said means for extruding mortar comprises a packing disk.

9. The combination of claim 8, wherein said packing disk comprises leather.

10. The combination of claim 8, wherein said packing disk comprises rubber.

11. The combination of claim 8, wherein said packing disk comprises plastic.

12. The combination of claim 8, wherein said packing disk has a diameter sufficiently less than the I.D. of said supply tube to allow air, but not cementitious particles, to pass between the sidewall of the packing disk and the inner wall of said supply tube.

13. For use with a mortar extrusion gun, the combination comprising:

a supply tube for holding a quantity of mortar to be dispensed, said supply tube including a mortar ejection aperture;

a spout including an outlet aperture for dispensing mortar; and means for, only upon at least partial filling of said supply tube with mortar, retaining and supporting said spout in fluid sealed relation with said supply tube upon insertion of said spout into said supply tube and at least partially through said mortar ejection aperture.

14. The combination of claim 13, further comprising mortar in said supply tube, said mortar consisting essentially of 2 parts cement, 3 to 4.4 parts sand, 0.85 to 1 part HILLBEST, and 2.5 to 2.9 parts water, on a volumetric basis.

15. The combination of claim 13 further comprising a packing disk in an open end of said supply tube opposite said mortar ejection aperture.

16. The combination of claim 15, wherein said packing disk comprises leather.

17. The combination of claim 15, wherein said packing disk comprises rubber.

18. The combination of claim 15, wherein said packing disk comprises plastic.

19. The combination of claim 15, wherein said packing disk has a diameter sufficiently less that the I.D. of said supply tube to allow air, but not cementitious particles, to pass between the sidewall of the packing disk and the inner wall of said supply tube.

* * * * *